US006082053A

United States Patent [19]

Bischof et al.

[11] Patent Number: 6,082,053

[45] Date of Patent: Jul. 4, 2000

[54] MOVABLE PARTITION

[75] Inventors: Markus Bischof, Altenhrain, Switzerland; Lothar Ginzel, Sobwerto, Germany; Stefan Rechsteiner, Stead, Switzerland

[73] Assignee: DORMA GmbH + Co. KG, Ennepetal, Germany

[21] Appl. No.: 09/194,861

[22] Filed: Nov. 6, 1998

Related U.S. Application Data

[63] Continuation-in-part of application No. PCT/DE97/00884, Apr. 30, 1997.

[30] Foreign Application Priority Data

May 7, 1996 [CH] Switzerland ..... 1160/96

[51] Int. Cl.[7] ..... E05F 15/14

[52] U.S. Cl. ..... 52/64; 52/238.1; 52/243.1; 49/221; 49/409; 49/412

[58] Field of Search ..... 52/64, 66, 243.1, 52/238.1; 49/217, 221, 409–412

[56] References Cited

U.S. PATENT DOCUMENTS

| | | | |
|---|---|---|---|
| 3,683,100 | 8/1972 | Deal et al. | 52/243.1 |
| 3,748,793 | 7/1973 | Tompkins et al. | 53/243.1 |
| 4,833,840 | 5/1989 | Kalischewski et al. | 52/64 |
| 5,090,171 | 2/1992 | Kano et al. | 52/243.1 |
| 5,193,319 | 3/1993 | Claassen et al. | 52/243.1 |
| 5,406,761 | 4/1995 | Hobbiebrunken et al. | 52/243.1 |
| 5,471,791 | 12/1995 | Keller | 52/64 X |
| 5,577,348 | 11/1996 | Keller | 52/64 X |

FOREIGN PATENT DOCUMENTS

| | | |
|---|---|---|
| 3147273 | 7/1983 | Germany . |
| 4015870 | 11/1991 | Germany . |
| 9214915 | 4/1993 | Germany . |
| 4424660 | 9/1995 | Germany . |

*Primary Examiner*—Richard Chilcot
*Attorney, Agent, or Firm*—Nils H. Ljungman & Associates

[57] ABSTRACT

The movable partition system has a plurality of movable partition elements placed on a horizontal rail. Each of at least two of the movable partition elements has its own electric motor. Each electric motor has a current collector connected to it which passes along at least two conductor rails which are part of the electrical circuit when the electric motor is moved. These rails are connected via lines to a control unit which controls the power supply and the operation. One conductor rail is connected with a single line. On the other hand, at least one other conductor rail has a plurality of lines which lead to electrical connections or taps which are isolated from one another by insulators. This isolation permits the control unit to control the individual flow of current to each separate tap. This makes it possible to individually control and position the individual movable partition elements.

20 Claims, 8 Drawing Sheets

17
4
19
18
20
28
21
28
22
28
23
4
24
25
26
4
27
9
10

MOVABLE PARTITION

CONTINUING APPLICATION DATA

This application is a Continuation-In-Part application of International Application No. PCT/DE97/00884, filed on Apr. 30, 1997, which claims priority from the Switzerland Patent Application No. 1160/96, filed on May 7, 1996. International Application No. PCT/DE97/00884 was pending as of the filing date of the above-cited application. The United States was an elected state in International Application No. PCT/DE97/00884.

BACKGROUND OF THE INVENTION

1. Field of the Invention

This present invention relates to a motor-driven movable partition which has at least one movable wall element that is supported on and can be moved in, or on, at least one stationary and horizontally oriented guide rail.

2. Background Information

Such movable partitions have an array of designs and practical uses. Depending on the desired function, the individual movable partition elements can be constructed using different materials. Solid panels can be constructed with wood or metal to create a movable wall. Other panels could be designed using glass or clear plastic to allow light into a partitioned area. These movable partitions can be used to break up or divide a large room or area into smaller sections. Such movable partitions can be used, for example, to subdivide areas in offices, schools, or shopping centers. In shopping centers, for example, the movable partition must be operated several times a day to open and close stores or rooms. Often times, it becomes necessary to only partly open or close such movable partitions to enclose a specific area or restrict the opening. The partitions may be closed halfway to achieve this function. But to obtain further division of a room outside of an opening and closing sequence requires more effort. Since the movable partition elements are usually restricted to moving from one side of the path of the guide rails to the other, it is necessary to manually detach and place the individual partitions in the desired position to achieve a specific division.

German Patent No. 44 24 660 C1 discloses a horizontal movable partition in which an additional rail system is installed in the ceiling area in front of an existing guide rail in which the individual elements can be moved. In this rail system runs a switchable coupling device which is equipped with an identification system to locate the individual elements which contain corresponding indicators, and to move the movable partition elements into the parked position in which they are pivoted by 90 degrees. The entire system is driven by an electric motor which drives an endless belt via a pulley. In connection with a programmable control mechanism, the identification system is controlled so that, after it executes a learning cycle, it recognizes the individual elements and moves them into the desired parked position or into the desired position in which the partition is closed. It is also possible to realize only a partial opening, so as not to open the entire facade, e.g. in cold weather. The switchable coupling device consists of an electromagnet, attached to the armature of which is a push rod which, in its projecting portion, is realized in a fork shape so that it detects a connecting pin between the trolley and an element located beneath it, and thus the entire element moves inside the guide rails according to the selected program. The coupling device and the identification system can be supplied with the corresponding signals and the required power either by means of sliding contacts or by means of a drum cable. The identification system can therefore be a sensor such as a proximity switch, for example, or it can use optical systems, magnets with corresponding reed contacts and/or switches.

German Patent No. 40 15 870 A1 describes a sliding door that consists of a plurality of panels, the individual panels of which are moved by means of rollers in a double rail system in the form of a guide rail. In that case, when the sliding door is closed, the individual panels form a facade. To open the facade, the panels are manually moved into a parked position via curved rail segments.

OBJECT OF THE INVENTION

The object of the present invention is to create a motor-driven movable partition that makes it possible to actuate and position the individual movable partition elements, is easy to manufacture and in particular a system in which the drive components are compact in terms of their vertical and horizontal dimensions.

Another object of this present invention is to create a movable partition system that permits the individual operation and positioning of individual partition elements.

SUMMARY OF THE INVENTION

The present invention teaches that these objects can be accomplished by having at least some of the individual movable partition elements have at least one drive unit of their own, by means of which the movable partition element in question can be moved along the guide rail independently of and/or simultaneously with the other movable partition elements. Additional embodiments of the invention are described herein below. The invention teaches that some or all of the movable partition elements have their own drive unit. The drive unit consists essentially of an electric motor, whereby its drive shaft can be provided with means that provide an effective connection with engagement surfaces or profiles that run along the guide rail or approximately parallel to it, thereby making possible the movement of the individual movable partition elements. For such an effective connection, the invention teaches the use of a pinion that can be positively and non-positively connected to the drive shaft. The gear teeth of the pinion are thereby engaged in a geared engagement profile that has an essentially identical modulus. The engagement profile is thereby a toothed belt. The toothed belt can thereby be fastened in or on the guide rail.

The present invention teaches that, in one possible embodiment of the present invention, these objects can also be accomplished by having at least some of the individual movable partition elements have at least one drive unit of their own, by means of which the movable partition element in question can be moved along the guide rail independently of and/or simultaneously with the other movable partition elements. The invention teaches that some or all of the movable partition elements have their own drive unit. The drive unit consists essentially of an electric motor, whereby its drive shaft can be provided with means that provide an effective connection with engagement surfaces or profiles that run along the guide rail or approximately parallel to it, thereby making possible the movement of the individual movable partition elements. For such an effective connection, the invention teaches the use of a pinion that can be connected to the drive shaft by essentially any type of connecting arrangement or structure, such as bolts, screws, pins, fasteners, welding, adhesive bonding, pressure fittings, clamps, splines, form fittings, and contour fittings. What is meant by positively and non-positively connected in at least one embodiment of the invention is listed in the previous sentence. The gear teeth of the pinion are thereby engaged in a geared engagement profile that has an essentially identical modulus. The engagement profile is thereby a toothed belt. The toothed belt can thereby be fastened in or on the guide rail.

So that the drive units can be supplied with the necessary electrical energy, the invention teaches the use of a current collecting device that interacts with a stationary bus bar or conductor rail device that extends along the guide rail.

Because the invention teaches the preferable use of a direct current motor as a drive motor, the bus bar device consists of two parallel bus bars. To be able to actuate the movable partition in sections, at least one of the two bus bars can be divided into a plurality of segments that are isolated from one another and can be individually supplied with current by means of a programmable control. The control system can thereby be connected by lines, the number of which equals the number of segments that are isolated from one another. For example, one or more individual segments can be supplied with power, as a consequence of which the corresponding movable wall elements are to be moved in the guide rail into very specific areas. It is thereby possible to move a plurality of movable wall elements simultaneously. As a result of this inventive step, the time required to move an entire movable partition can be drastically reduced. It is also possible to move only individual movable partition elements, which would, for example, represent the partial opening or closing of the movable partition.

As an alternative to the type of drive described above by means of pinions and toothed belts, for example, a friction gear or frictional wheel drive can also be used. For this purpose, on the drive shaft there can be a wheel with a non-skid rubber or elastomer coating on its periphery, which can be effectively engaged with a frictional engagement surface on the guide rail.

The above discussed embodiments of the present invention will be described further hereinbelow with reference to the accompanying figures. When the word "invention" is used in this specification, the word "invention" includes "inventions," that is, the plural of "invention." By stating "invention," the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to one preferred embodiment of the invention which is illustrated in the accompanying drawings, in which.

DESCRIPTION OF THE PREFERRED EMBODIMENT

Figure 1:
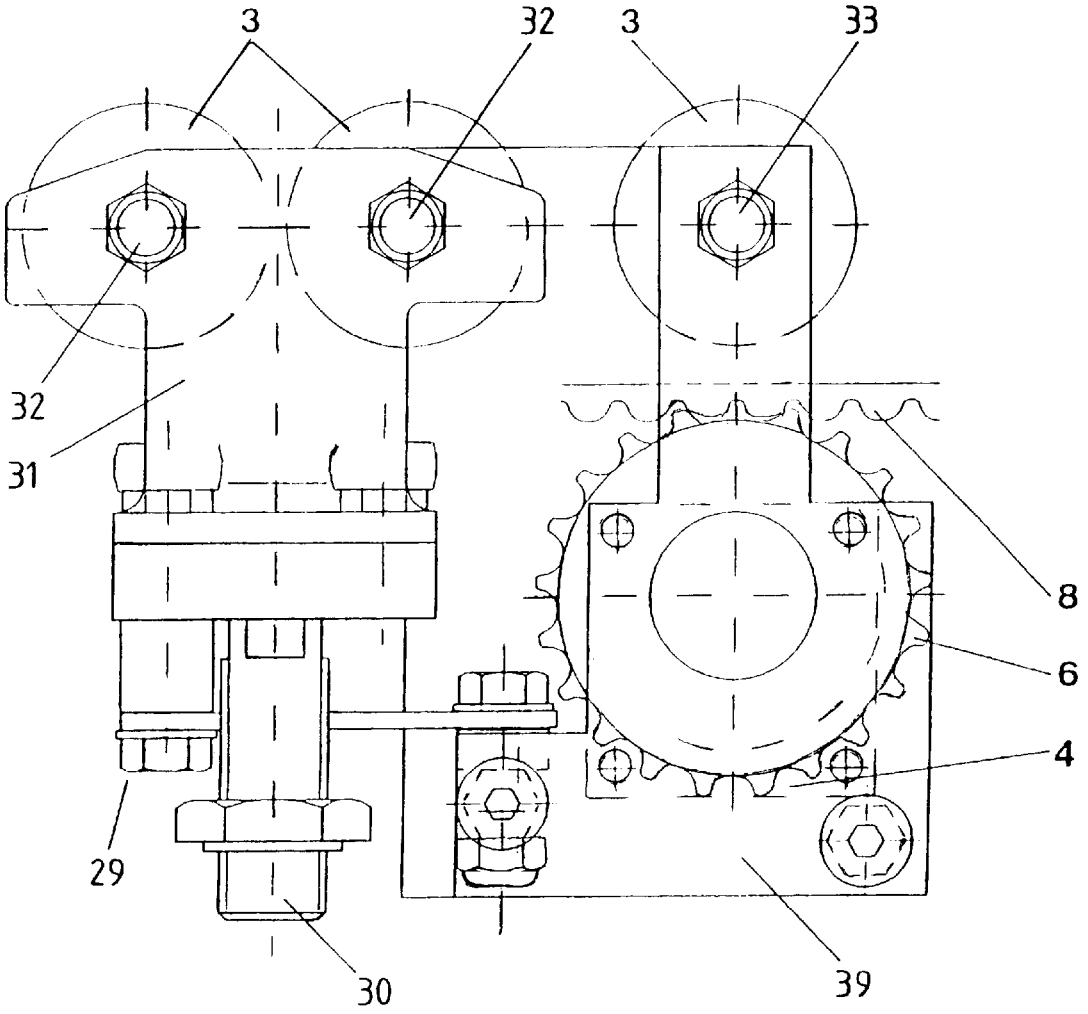
FIG. 1 shows a view of the drive unit of a movable partition element.
Figure 2:
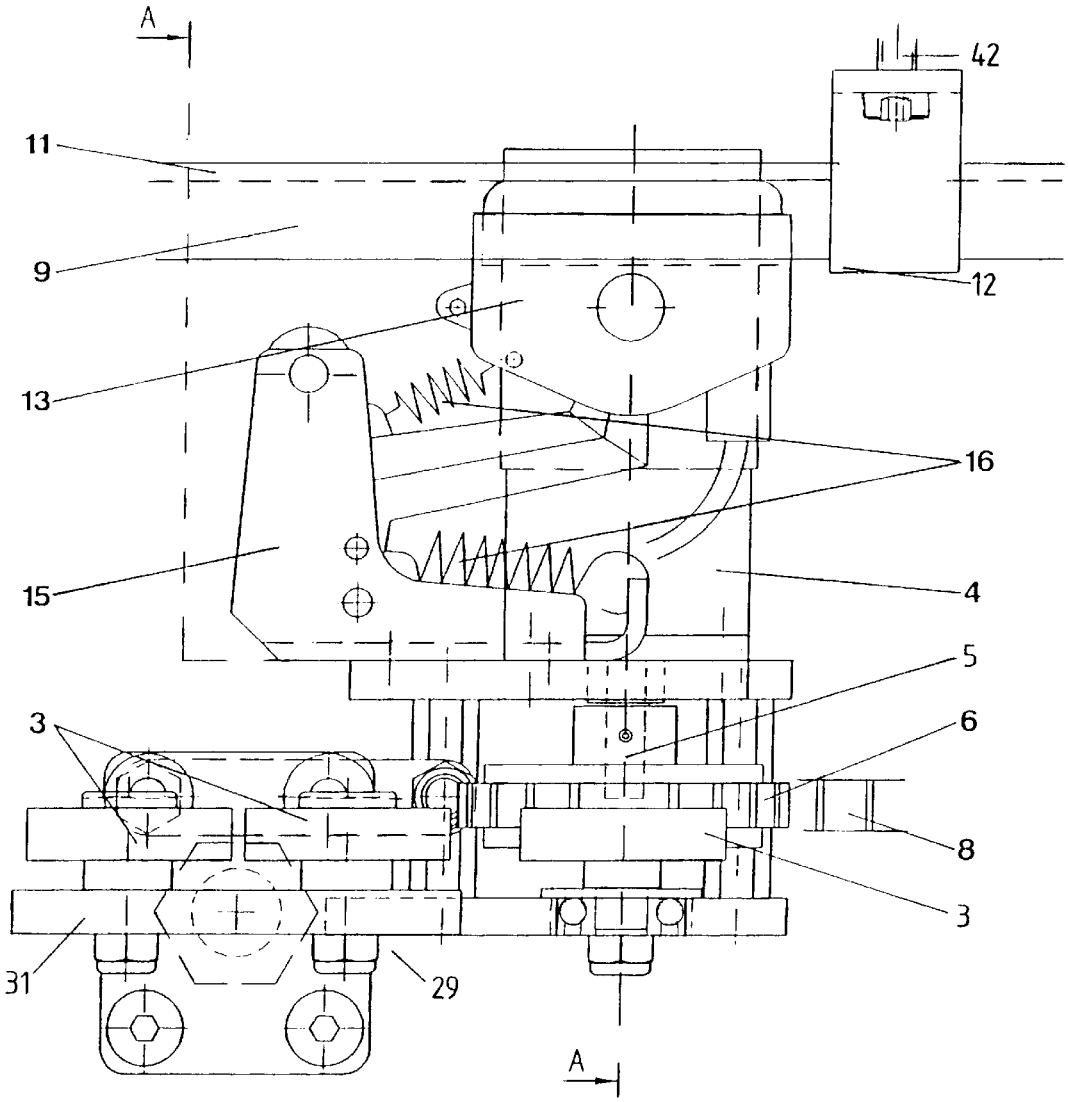
FIG. 2 shows an overhead view of the drive unit illustrated id FIG. 1.
Figure 3:
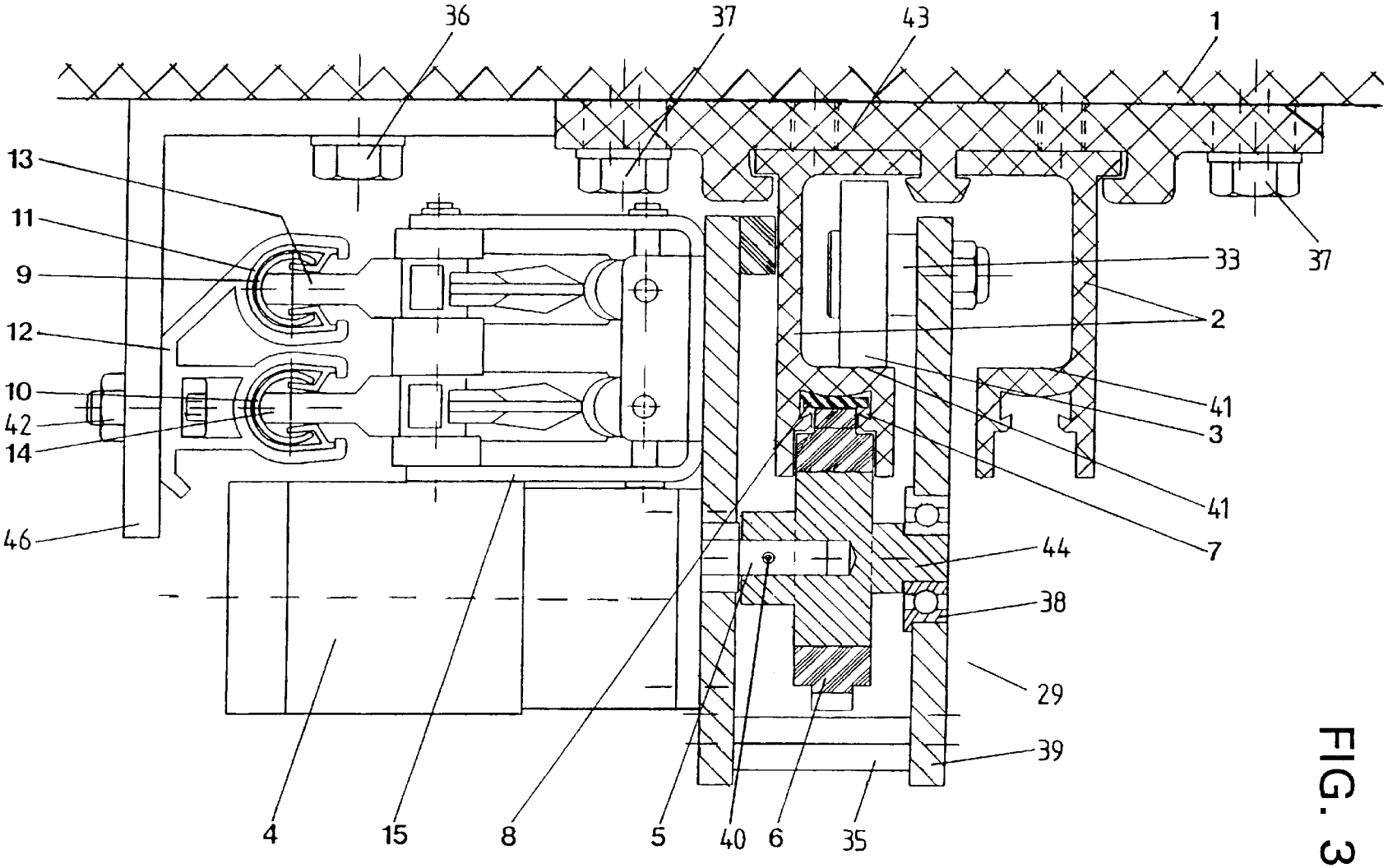
FIG. 3 shows a cross section along Line A—A in FIG. 2.
Figure 6:
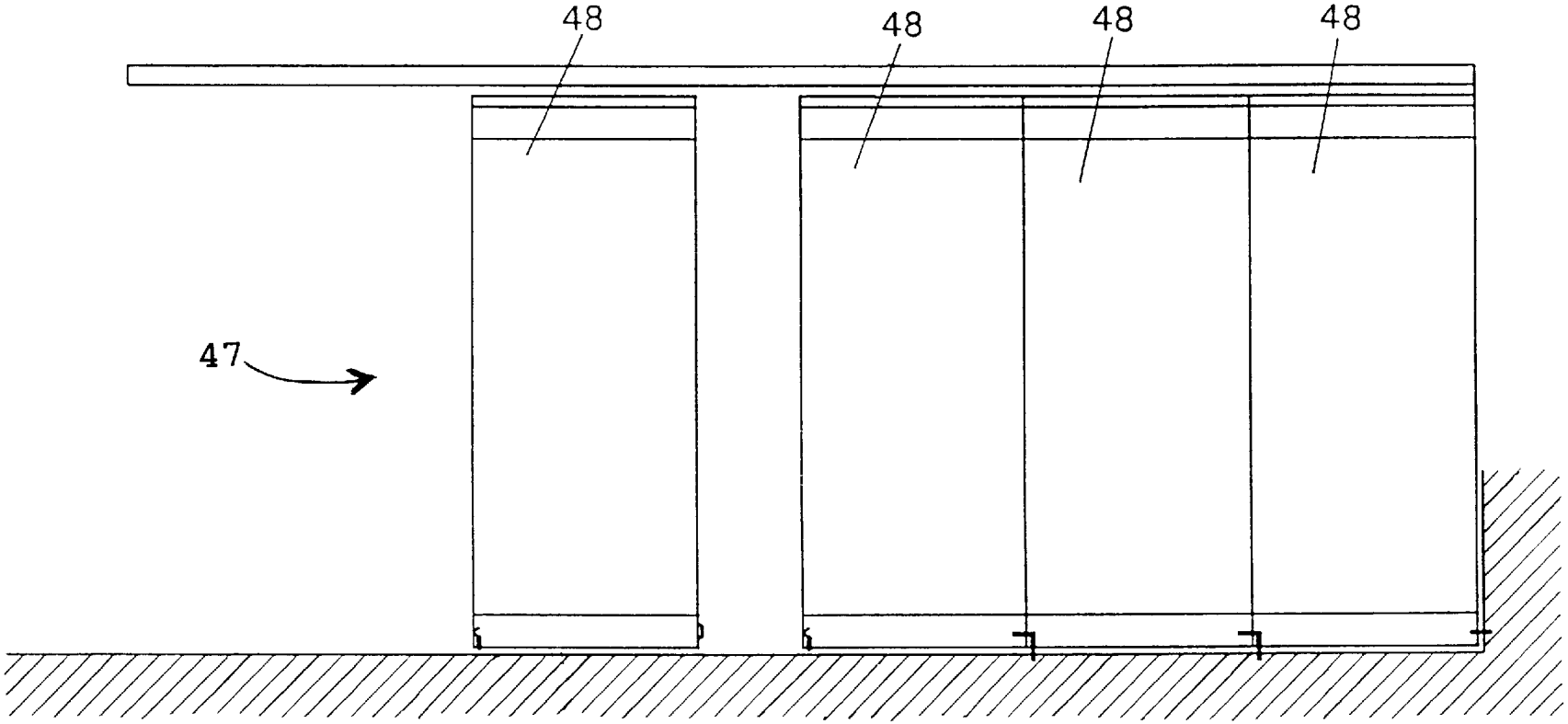
FIG. 6 shows one possible embodiment of a movable partition and movable partition elements.

The drive unit 29, as illustrated in FIGS. 1 to 3, of a movable partition 47, as shown in FIG. 6, must be fastened to the upper end of the individual movable partition elements 48, with one or more drive units for each element. As in the known art, the movable partition elements 48 can be mounted and moved on a guide rail 2 that is mounted and runs horizontally in the vicinity of the ceiling 1 of the space to be divided or enclosed. The guide rail 2 can thereby be fastened either directly or by means of a mounting profile 43 that is attached to the ceiling area 1 by means of fasteners 37. The individual movable partition elements 48 are generally realized in the form of vertically oriented narrow rectangles that are provided in the vicinity of both ends of their upper edge with a defined bearing system that is engaged in the guide rail 2. In this example, the guide rail 2 in question is essentially C-shaped, and two bearing systems, each near the horizontal ends of the movable partition elements 48, are guided in a suspended manner by means of rollers. One of these two bearing systems is formed by the drive unit 29 which is illustrated and described in detail below. The drive unit 29 is thereby attached by means of partition element connections 30 that are screwed into the partition element 48.

Figure 3A:
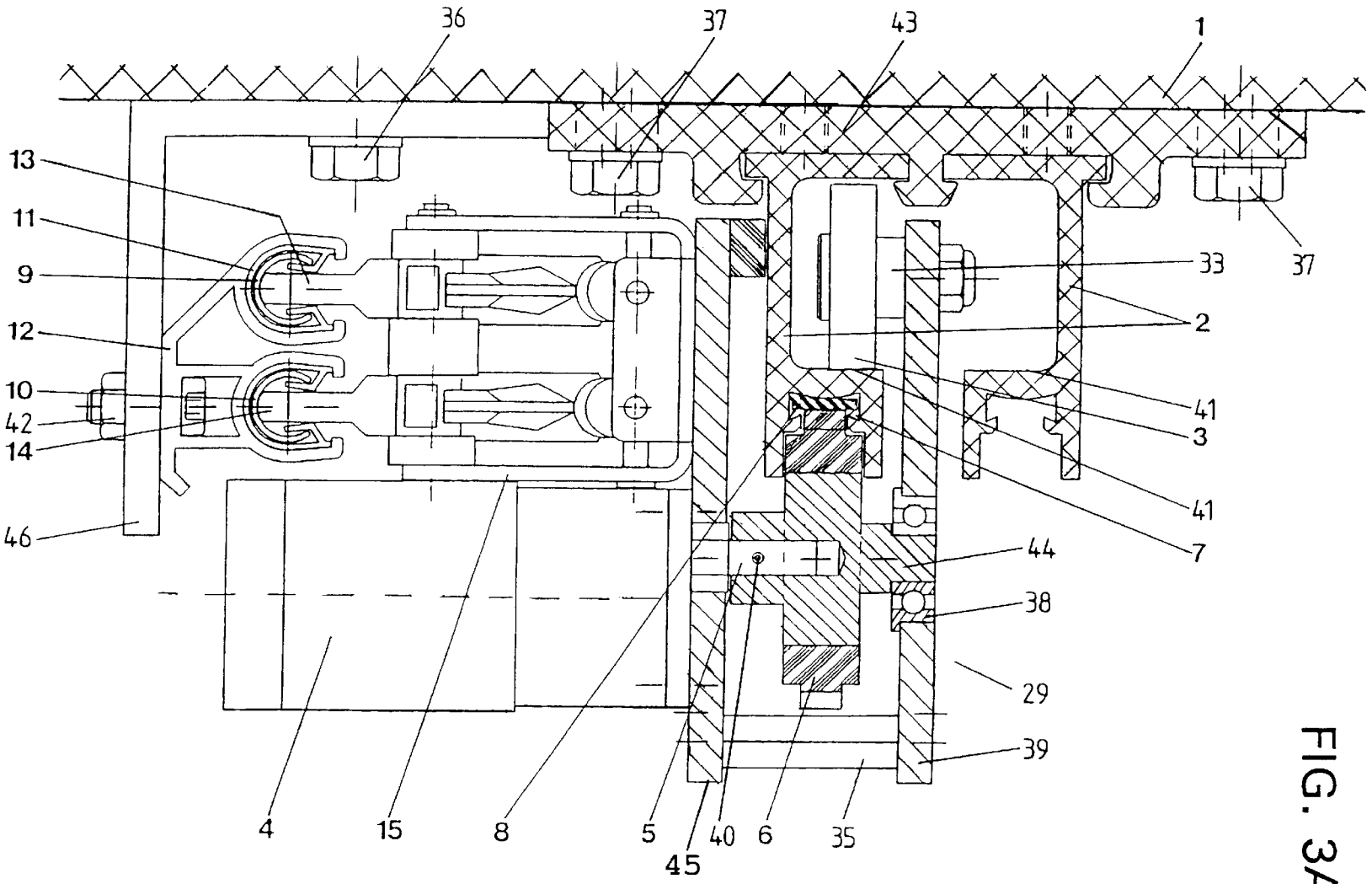
FIG. 3A shows one possible embodiment of the drive unit with a base mounting.

The drive mechanism is driven by an electric motor 4, which is preferably realized in the form of a direct current motor. On the drive shaft 5 of the electric motor 4, in this example there is a drive pinion 6 that is designed so that it is engaged in a toothed belt 8 located in a corresponding recess 7 of the guide rail 2. The toothed belt 8 can thereby also be attached to the guide rail 2. The toothed belt 8 extends over the entire length of the guide rail 2, so that the movable wall element 48 can be moved along the guide rail 2 by the rotation of the drive pinion 6 by means of the electric motor 4. The drive shaft 5 that extends out of the electric motor can be positively and non-positively connected to the drive pinion 6 by means of a pin 40. The drive pinion 6 can be designed so that there is a shaft projection or driver 44 located on the side facing the electric motor 4, which projection 44 is engaged in a bearing 38. The bearing 38 is inserted in a mounting 39 which is connected by means of spacers 35 to the base mounting or bracket 45, as shown in FIG. 3A, of the drive unit 29. Fastened to the base mounting 45, next to the electric motor 4, is a movable mounting 15 for the power supply as well as a mounting or bracket 31 for the rollers 3 that are mounted by means of shafts 32, 33. The rollers 3 thereby run on running surfaces 41 that are inside the guide rail 2.

The realization of the power supply of the electric motors 4 is of essential importance. For this purpose, each drive unit 29 can be provided with a current collector device which is effectively connected in an electrically conducting connection with two stationary bus bars 9, 10 that correspond to the guide rail 2 and are part of the power circuit. The two power rails 9, 10 are protected by insulation 11, and are located in a profile 12 that runs along side, e.g. by means of angle brackets 46 that are fastened in the ceiling area 1 by means of fasteners 36. The current collector device thereby has two current collectors 13, 14 which extend toward the bus bars 9 and 10 respectively and thus interact. The two current collectors 13, 14 are located on a mounting 15 which is in turn firmly connected to the base mounting 45 of the drive unit 29. If the drive unit 29 and the respective partition units 48 thus connected to it are moved along the guide rail 2, the two current collectors 13, 14 slide along on or in the guide rails 9, 10 in an electrically conducting connection and thus supply the electric motor 4 with the necessary drive energy which is supplied by a control unit 17.

The guide rails 2 and thus also the bus bars 9, 10 can not only follow a straight path, but can also be laid around a corner with a relatively small radius. This layout may be necessary, for example, to enclose a sales area in a corner, or also to move the movable partition elements 48 around the corner into a parking area, parking position, or switching yard that is out of sight. To also essentially guarantee a reliable contact between the current collectors 13, 14 and the bus bars 9, 10 in the curved corner areas, the mounting 15 can be advantageously equipped with a spring system 16. By means of this spring system, the electrical contact between the current collectors and the bus bars is protected from undesirable discontinuities caused by interruptions during the opening or closing process.

To further explain, in at least one possible embodiment of the present invention, the current collectors 13, 14 can be attached to a spring system 16. This spring system 16 can exert a biasing force on the current collectors 13, 14. Therefore, when the current collectors 13, 14 are moving along the bus bars 9, 10, they can essentially be held in constant contact with the bus bars 9, 10 by the force exerted on the current collectors 13, 14 by the spring system 16. The spring system 16 could permit the current collectors 13, 14 to have a flexible rather than a fixed base, thereby possibly preventing an interruption in connection if the path of the bus bars 9, 10 were to change from a straight path to a curved path, for example. Such a design could possibly allow the movable partition elements to be moved around a corner along a curved path without an interruption of the flow of power to or from the motor.

FIG. 3A shows one possible embodiment of the drive unit 29 with a base mounting 45.

Figure 4:
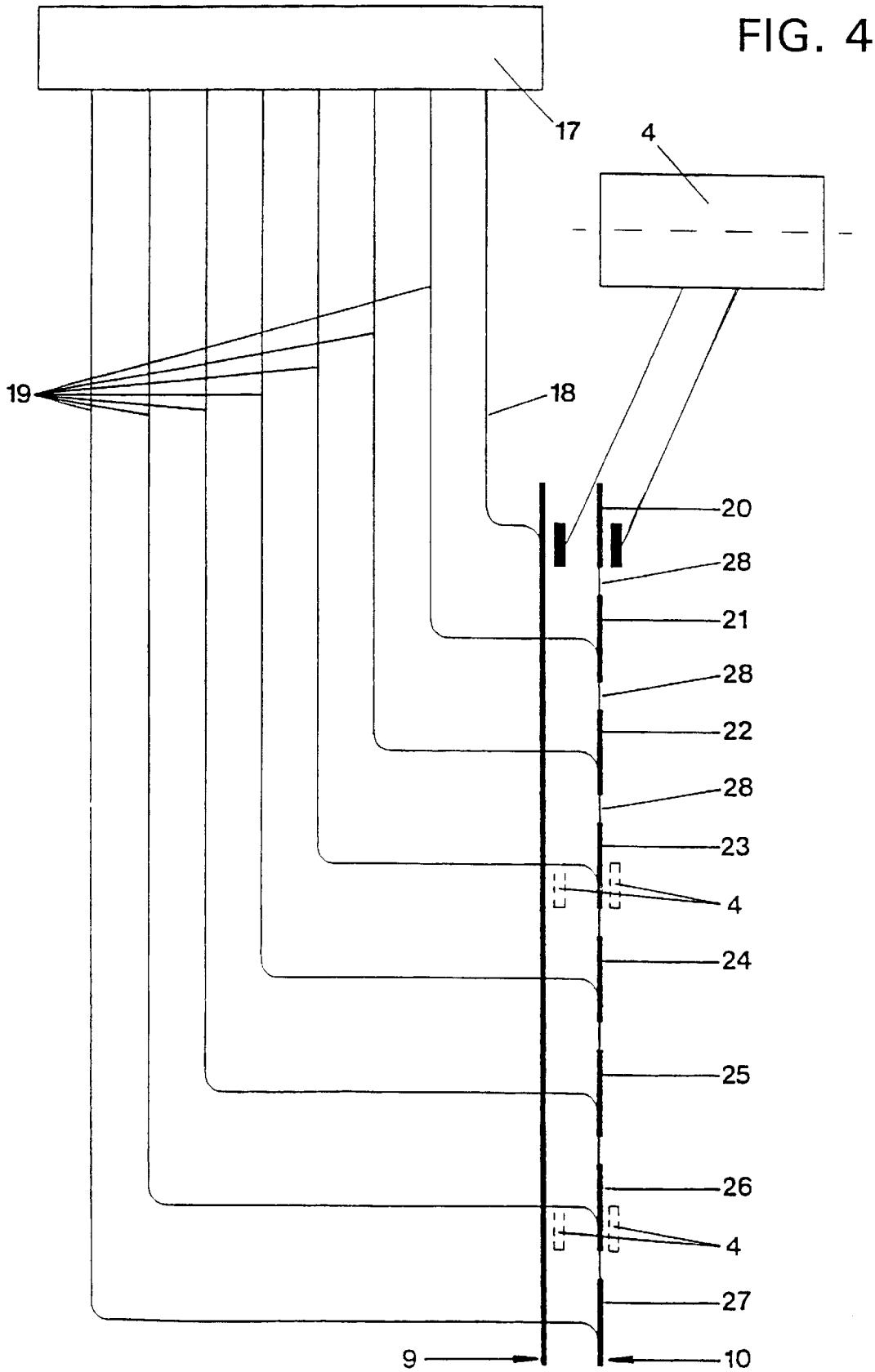
FIG. 4 is a schematic diagram of the control system.

The following portion of the explanation relates to the schematic illustration in FIG. 4 of the system for the control of a movable partition 47 that contains a plurality of movable partition elements 48. The two bus bars 9, 10 are each connected by means of electric lines 18, 19 to the control system 17 that provides the power feed and controls the sequence of operations. The first bus bar 9 that is part of the power circuit is thereby connected to the control unit 17 by means of a single electric line 18. The second bus bar 10 of the power circuit, on the other hand, has a plurality of electric lines 19.

This second bus bar 10 is divided into individual segments, e.g. electrical connections or taps 20–27. These electrical connections or taps 20–27 are each isolated from one another by means of isolators 28 and are each provided with their own electric line 19, so that each electrical connection or tap 20–27 can be individually supplied with current by means of the control unit 17. If only a specific movable partition element 48 is to be moved, i.e. in concrete terms, only the electric motor 4 used to drive it, by a specified distance, the number of bus bar segments corresponding to this distance is supplied with power by the corresponding electrical connections or taps. The control unit, thanks to the division of the bus bar 10 into individual segments 20–27, knows at all times in which portion of the track the electric motor 4 in question is currently located.

The motor-driven movable partition 47 constructed and operated on the basis of this control principle offers a whole series of decisive advantages over similar movable partitions of the prior art. First, on account of the double bus bars 9, 10, whereby a single bus bar is divided into segments, the partition system has two poles for a plurality of electric motors 4. Second, the electric motors 4 can be positioned without the use of limit switches. Third, the control system 17 makes it possible at all times to monitor the current position of the movable partition elements that correspond to the electric motors 4 and thus to the individual drive units 29.

Figure 5:
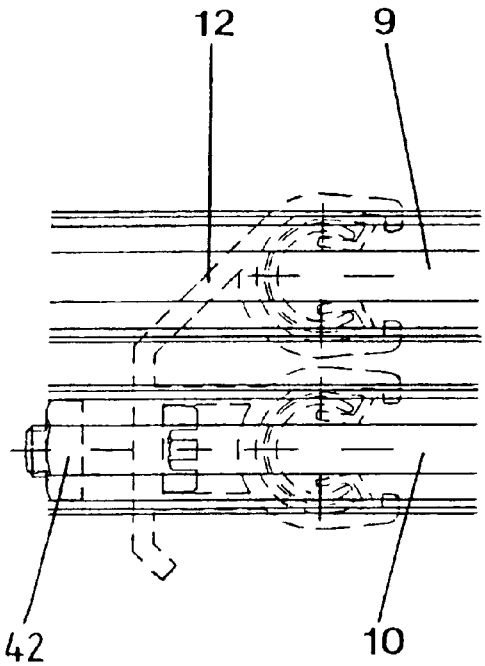
FIG. 5 is a detail of the bus bars.
Figure 5A:
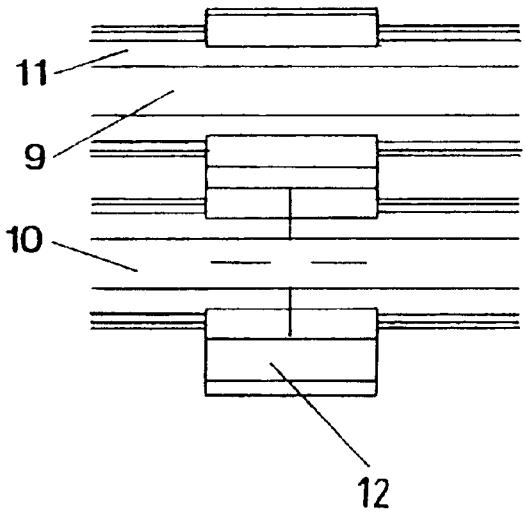
FIG. 5A is a detail of the bus bars.

FIGS. 5 and 5A show details of sections of the bus bars 9, 10.

FIG. 6 shows one possible embodiment of the movable partition 47. Individual movable partition elements 48 are also shown.

Figure 7:
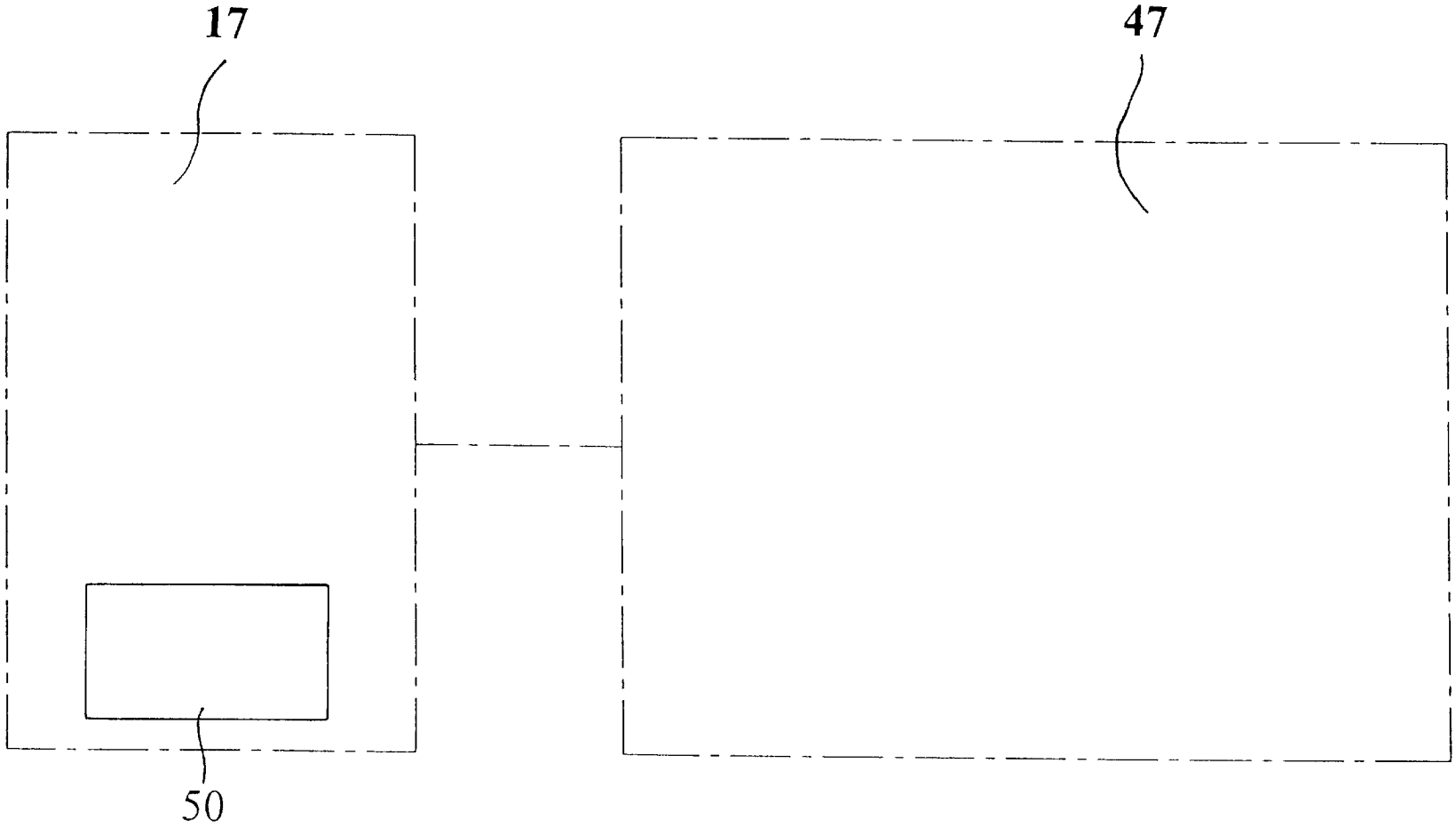
FIG. 7 is another schematic diagram of the control system.

FIG. 7 shows another schematic diagram showing the operative connection between the control unit 17 and the movable partition 47. FIG. 7 further shows the positioning program 50 which can be part of the control unit 17.

The invention teaches that the individual actuation, positioning and monitoring of the individual movable partition elements 48 can be done smoothly and easily. Because only one load-bearing profile 12 supporting the double bus bars 9, 10 is required to control the drive for a plurality of movable partition elements 48, and the power supply can be located next to the guide rail 2, the system takes up only a small amount of space vertically and horizontally. That would not be the case if a separate bus bar or a drum cable had to be present for each movable partition element 48 or its electric motor 4. With all these advantages, the movable partition 47 is relatively simple to manufacture. Therefore even a retrofitting of existing movable partitions with the advantages taught by the invention become technically feasible. It is also easy to move the movable partitions around corners.

The control system 17 used is able, without requiring additional contacts or auxiliary devices, to determine and monitor the movements and positions of the individual movable partition elements 48. An example of such a control system which may possibly be used in the present invention can be found in Ser. No. 08/614,858, filed on Mar. 13, 1996 by inventor Schack under the original title "Wall Partition System with Automatic Control of Wall Panels and a Device and Method for the Operation of an Automatic Wall Partition System," claiming priority from documents P 44 24 660.9, filed on Jul. 14, 1994, and PCT/DE95/00717 filed on Jun. 1, 1995. This capability is also present when the movable partition 47 is stationary, and can be maintained even after a power failure. If the power has been off for a certain period of time, the control system 17 detects the position of the movable wall elements 48 and transmits a corresponding signal to the common bus bar 9, and because of the divided bus bar 10, the control system 17 is able to detect the position of the movable partition elements 48. For this purpose, the electric motor acts as the energy pulse emitter for the corresponding movable partition element 48. In connection with a program that is stored in the control unit 17, the position of the movable partition element 48 is thus determined, even if the individual movable partitions 48 have been moved manually during the power outage. In such a case, a "classification" of the individual movable partition elements 48 takes place. It is also impossible or virtually impossible or highly unlikely for a trailing movable partition element 48 to overtake and collide with the movable partition element 48 that is ahead of it in the direction of travel. This latter situation is also monitored by the control system 17.

In other words, the control system 17 has the ability, without requiring additional contacts or auxiliary devices, to determine and monitor the movements and positions of the individual movable partition elements 48. An example of such a control system which may possibly be used in the present invention can be found in Ser. No. 08/614,858, filed on Mar. 13, 1996 by inventor Schack under the original title "Wall Partition System with Automatic Control of Wall Panels and a Device and Method for the Operation of an Automatic Wall Partition System," claiming priority from documents P 44 24 660.9 filed on Jul. 14, 1994, and PCT/DE95/00717, filed on Jun. 1, 1995. The ability to determine and monitor movement and position of the partition elements 48 is present when the movable partition 47 is stationary or moving. Should the power be disconnected, the control system 17 can reestablish detection of the partition elements 48 when power is restored. The control system 17 can detect the electrical current associated with the individual electric motors 4 of the drive units 29 of the movable partition elements 48. Each motor 4 now acts as an energy pulse emitter by being part of a flow of energy. The control system 17 can now identify where the motor 4 and its corresponding partition element 48 are located. This again can be made possible by the division of one of the bus bars 10. The circuit can be completed along a specific electrical line leading to the control system 17, thereby permitting the control system 17 to establish the location of the partition element 48 according to that divided section of the bus bar. The control system 17 can then utilize a positioning program 50 that is stored in its memory. This learned positioning program 50 can establish a set position for the movable partition elements 48. The positioning program 50 can allow the control system 17 to supply power to the partition elements 48 to cause them to move to specific areas as designated by the positioning program's preset formation. Even if the elements 48 have been manually moved or repositioned during a power failure, the control system 17, after power has been restored, can move the elements 48 back to the positions designated by the positioning program 50. This constant monitoring by the control system 17 also can prevent the movable partition elements 48 from overtaking or colliding with each other.

It is within the scope of the invention to realize the movable partition 47 with technical details that differ from the preferred embodiment described above. For example, instead of only one bus bar, both bus bars 9, 10 could be divided into a plurality of taps 20–27.

In one embodiment of the teaching of the invention, whereby each movable partition element 48 is provided with an electric motor, a friction gear can also be used instead of the drive pinion 6 on the drive shaft 5. This friction gear can interact directly or indirectly with a running surface in or on the guide rail 2, whereby the actuation of the individual movable partition elements 48 remains possible.

One feature of the invention resides broadly in the movable partition 47 for an automatic partition system with individual movable partition elements 48 that can be moved by an electric motor 4 by means of a drive belt, and each of which can be moved horizontally by connecting means with two rollers 3 in a guide rail 2 fastened to the ceiling area 1, characterized by the fact that at least some of the individual movable partition elements 48 have at least one drive unit 29 of their own, by means of which the movable partition element 48 in question can be moved along the guide rail 2 independently of and/or simultaneously with the other movable partition elements 48.

Another feature of the invention resides broadly in the movable partition 47 characterized by the fact that the drive unit 29 has an electric motor 4 that is located on the respective movable partition element 48, and the drive shaft 5 of which is provided with means by which the movable partition element 48 can be moved along the guide rail 2 in effective connection with a frictional contact surface or a frictional contact profile located along the guide rail 2 or approximately parallel to it.

Yet another feature of the invention resides broadly in the movable partition 47 characterized by the fact that a drive pinion 6 is non-rotationally installed on the drive shaft 5 of the electric motor 4, e.g. of a direct current motor, which drive pinion 6 is designed for engagement with a toothed engagement profile of a toothed belt 8, which is located in a corresponding recess 7 that extends along the guide rail 2.

Still another feature of the invention resides broadly in the movable partition 47 characterized by the fact that a friction gear is located on the drive shaft 5 of the electric motor 4 and interfaces with a frictional engagement surface which is in or on the guide rail 2.

A further feature of the invention resides broadly in the movable partition 47 characterized by the fact that the means or the drive unit 29 to move a movable partition element 48 along the guide rail 2 are provided with a current collector device which is oriented in a stationary manner in relation to the guide rail 2 so that bus bars 9, 10 are present that interact with current collectors so that there a closed circuit exists when the movable partition elements 48 are being moved.

Another feature of the invention resides broadly in the movable partition 47 characterized by the fact that at least one of the two bus bars 9, 10 is divided into a plurality of segments that are isolated from one another, i.e. taps 20–27 that can be supplied with current individually.

Yet another feature of the invention resides broadly in the movable partition 47 characterized by the fact that the two bus bars 9, 10 are each connected by means of electric lines 18, 19 with a control system 17 that controls the power supply and the sequence of operations.

Still another feature of the invention resides broadly in the movable partition 47 characterized by the fact that the control system 17 is connected by means of a plurality of electric lines 19 with at least one bus bar 10 that is divided into a plurality of taps 20–27 that are isolated from one another, that an individual electric line 19 leads to each of the taps 20–27 that are isolated from one another.

A further feature of the invention resides broadly in the movable partition 47 characterized by the fact that the design system 17 is designed so that to move a specified movable partition element 48, i.e. to move the electric motor 4 used to drive the element in question, the number of bus bar segments corresponding to the desired distance is supplied with current, i.e. from taps 20–27 of the one bus bar 9 or 10.

One feature of the invention resides broadly in the movable partition 47 for an automatic partition system with individual movable partition elements 48 that can each be moved horizontally by means of a mounting 31 with two rollers 3 in a guide rail 2 fastened to the ceiling area 1, whereby at least some of the individual movable partition elements 48 have a drive unit 29 of their own, by means of which the movable partition element 48 in question can be moved along the guide rail 2 independently of and/or simultaneously with the other movable partition elements 48, such that the drive unit 29 has an electric motor 4 with a drive pinion 6 which is fastened to the movable wall element 48 by means of a base mounting 45, such that on the drive pinion 6, on the side facing the electric motor 4, there is a projection 44 that is engaged in a bearing 38 that is inserted in a mounting 39 which is connected by means of spacers 35 with the base mounting 45, whereby the drive pinion 6 interacts with means that are fastened to the guide rail 2 or approximately parallel to the guide rail and have an engagement surface or an engagement profile that allows the movement of the individual movable partition elements 48, and that also, next to the guide rail, separated by insulation 11, stationary bus bars 9, 10 that are provided with current collectors 13, 14 that are provided with a spring system 16 that is located on the respective movable partition element 48 interact such that by means of a programmable control unit 17, the electric motor 4 is supplied with current, and the electric motor 4 is simultaneously switched so that it acts as an energy pulse emitter to detect the position of the connected movable partition element 48.

Another feature of the invention resides broadly in the movable partition 47 characterized by the fact that the drive pinion 6 is designed so that it is engaged in a toothed engagement profile of a toothed belt 8 which is located in a corresponding recess 7 on the guide rail 2.

Yet another feature of the invention resides broadly in the movable partition 47 characterized by the fact that the drive pinion 6 is replaced by a frictional drive wheel which interfaces with a frictional engagement surface which is on the guide rail 2.

Still another feature of the invention resides broadly in the movable partition 47 characterized by the fact that at least one of the two bus bars 9, 10 is divided into a plurality of segments that are isolated from one another, i.e. taps 20, 21, 22, 23, 24, 25, 26, 27 that can be supplied with current individually.

A further feature of the invention resides broadly in the movable partition 47 characterized by the fact that the control system 17 is connected by means of a plurality of electric lines 19 with at least one bus bar 10 that is divided into a plurality of taps 20, 21, 22, 23, 24, 25, 26, 27 that are isolated from one another, that an individual electric line 19 leads to each of the taps 20, 21, 22, 23, 24, 25, 26, 27 that are isolated from one another.

Another feature of the invention resides broadly in the movable partition 47 characterized by the fact that the design system 17 is designed so that to move a specified movable partition element 48, i.e. to move the electric motor used to drive the element in question, the number of bus bar segments corresponding to the desired distance is supplied with current, i.e. from taps 20, 21, 22, 23, 24, 25, 26, 27 of the one bus bar 9 or 10.

Yet another feature of the invention resides broadly in the movable partition 47 characterized by the fact that the electric motor 4 is a direct-current motor.

To further the explain the instant invention, such movable partitions can be used for a wide variety of applications. A circulating guide chain can also be provided in the vicinity of the guide rails, by means of which chain, when the drive mechanism is engaged, the movable partition elements can be moved in either direction. Depending on the application, the individual movable partition elements can consist of a solid panel, e.g. made of wood or metal, or with a panel, e.g. made of glass, to admit light. Such a movable partition can be used to subdivide a large space into smaller spaces. Such movable partitions can also be used to enclose storerooms in shopping centers or shopping malls or to separate them from the hall areas. In the latter case, for example, the movable partition must be actuated two or four times a day to open or close the store. A frequent requirement is to only partly subdivide a space so that, for example, the movable partition is only to be closed halfway. If the space is to be subdivided further, whereby with a single movable and closable wall partition that is normally moved only to one side, it becomes necessary to temporarily locate the movable partition elements on both sides of the room, the movable partition elements in question must be manually disconnected and manually moved into the desired position.

The sliding wall has a plurality of traveling sliding wall elements placed on a horizontal rail. Each sliding wall element has its own electric motor. Each electric motor has a current collector which passes along two fixed conductor rails which are part of the electrical circuit when the electric motor is moved. These rails are connected via lines to a control unit which controls the power supply and the operation. The first conductor rail is provided with a line. On the other hand, the second conductor rail has a plurality of lines which lead to taps which are isolated from one another by insulators, so that the control unit can feed individually each tap with current. This makes it possible to individually control and position the individual sliding wall elements.

Some examples of movable partitions which may be incorporated in an embodiment of the present invention are disclosed in U.S. Pat. No. 5,394,648, issued to Kordes on Mar. 7, 1995; U.S. Pat. No. 5,544,462, issued to Kordes on Aug. 13, 1996.

Some examples of current collectors which may be incorporated in an embodiment of the present invention are disclosed in U.S. Pat. No. 5,386,895, issued to Ohuchi on Feb. 7, 1995; U.S. Pat. No. 5,397,658, issued to Dunham on Mar. 14, 1995; U.S. Pat. No. 5,415,948, issued to Gauthier et al. on May 16, 1995; U.S. Pat. No. 5,464,706, issued to Dasgupta and Jacobs on Nov. 7, 1995; and U.S. Pat. No. 5,478,676, issued to Turi and Ray on Dec. 26, 1995.

Some examples of direct current motors which may be incorporated in an embodiment of the present invention are disclosed in U.S. Pat. No. 5,391,954, issued to Takehara and Kawamura on Feb. 21, 1995; U.S. Pat. No. 5,434,463, issued to Horski on Jul. 18, 1995; and U.S. Pat. No. 5,469,030, issued to Takei and Obara on Nov. 21, 1995.

Some examples of bus bars which may be incorporated in an embodiment of the present invention are disclosed in U.S. Pat. No. 5,421,751, issued to Bennett et al. on Jun. 6, 1995 and U.S. Pat. No. 5,422,440, issued to Palma on Jun. 6, 1995.

Some examples of toothed belts and toothed belt systems which may be incorporated in an embodiment of the present invention are disclosed in U.S. Pat. No. 5,392,831, issued to Thomas and Bishop on Feb. 28, 1995; U.S. Pat. No. 5,405,299, issued to Kubo et al. on Apr. 11, 1995; and U.S. Pat. No. 5,417,618, issued to Osako et al. on Ma. 23, 1995.

Some examples of control systems which measure operating Parameters and learn therefrom are disclosed in U.S. Pat. No. 5,406,473, issued to Yoshikura and Uno on Apr. 11, 1995; U.S. Pat. No. 5,471,668, issued to Soenen et al. on Nov. 28, 1995; U.S. Patent No. 5,191,272, issued to Torii et al. on Mar. 2, 1993; U.S. Pat. No. 5,223,820, issued to Sutterlin et al. on Jun. 29, 1993; and U.S. Pat. No. 4,655,188, issued to Tomisawa et al. on Apr. 7, 1987, which U.S. patents are hereby expressly incorporated by reference herein.

Some examples of computer systems and methods and their components which may be incorporated in an embodiment of the present invention are to be found in U.S. Pat. No. 5,379,428, issued to Belo on Jan. 3, 1995; U.S. Patent No. 5,398,333, issued to Shieve and Finch on Mar. 14, 1995; U.S. Pat. No. 5,390,301, issued to Scherf on Feb. 14, 1995; U.S. Pat. No. 5,404,544, issued to Crayford on Apr. 4, 1995; U.S. Pat. No. 5,418,942, issued to Krawchuk on May 23, 1995; U.S. Pat. No. 5,479,355, issued to Hyduke on Dec. 26, 1995; and U.S. Pat. No. 5,428,790, issued to Harper, et al. on Jun. 27, 1995.

Some examples of electromagnets and their components which may be incorporated in an embodiment of the present invention are to be found in U.S. Pat. No. 5,389,905, issued to Shibata et. on Feb. 14, 1995; U.S. Pat. No. 5,392,015, issued to Matsuoka on Feb. 21, 1995; U.S. Pat. No. 5,402,093, issued to Gibas and Paul on Mar. 28, 1995; and U.S. Pat. No. 5,410,289, issued to Futa on Apr. 25, 1995.

Some examples of closed-loop control circuits which may be incorporated in an embodiment of the present invention are to be found in U.S. Pat. No. 5,189,605, issued to Zuehlke et al. on Feb. 23, 1993; U.S. Pat. No. 5,223,072, issued to Brockman et al. on Jun. 29, 1993; and U.S. Pat. No. 5,252,901, issued to Ozawa et al. on Oct. 12, 1993.

Some examples of open-loop control circuits which may be incorporated in an embodiment of the present invention are to be found in U.S. Pat. No. 5,210,473, issued to Backstrand on May 11, 1993; U.S. Pat. No. 5,320,186, issued to Strosser et al. on Jun. 14, 1994; and U.S. Pat. No. 5,369,342, issued to Rudzewicz et al. on Nov. 29, 1994, which U.S. patents are hereby incorporated by reference herein.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Switzerland Patent Application No. 1160/96, filed on May 7, 1996, having inventors Markus Bischof, Lothar Ginzel, and Stefan Rechsteiner, and International Application No. PCT/DE 97/00884, filed on Apr. 30, 1997, and International Publication No. WO 97/42388, published Nov. 13, 1997, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this-invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

| AT LEAST PARTIAL NOMENCLATURE | |
|---|---|
| 1 | Ceiling area |
| 2 | Guide rail |
| 3 | Rollers |
| 4 | Electric motor |
| 5 | Drive shaft |
| 6 | Drive pinion |
| 7 | Recess |
| 8 | Toothed belt |
| 9 | Bus bar |
| 10 | Bus bar |
| 11 | Isolation |
| 12 | Profile |
| 13 | Current collector |
| 14 | Current collector |
| 15 | Mounting |
| 16 | Spring system |
| 17 | Control system |
| 18 | Electric line |
| 19 | Electric line |
| 20 | Tap |
| 21 | Tap |
| 22 | Tap |
| 23 | Tap |
| 24 | Tap |
| 25 | Tap |
| 26 | Tap |
| 27 | Tap |
| 28 | Isolator |
| 29 | Drive unit |
| 30 | Movable partition element connection |
| 31 | Mounting |
| 32 | Shaft |
| 33 | Shaft |
| 34 | Mounting |
| 35 | Spacer bolt |
| 36 | Fastener |
| 37 | Fastener |
| 38 | Bearing |
| 39 | Mounting |
| 40 | Pin |
| 41 | Running surface |
| 42 | Fastener |
| 43 | Retaining profile |
| 44 | Shaft projection |
| 45 | Base mounting |
| 46 | Angle brackets |

What is claimed is:

1. A movable partition system comprising:

at least two movable partition elements;

each of said at least two movable partition elements comprising a top portion and a bottom portion;

a guide rail;

said guide rail being fastened to a ceiling area;

said at least two partition elements being configured to be moved horizontally along said guide rail;

at least two first mounting elements;

each of said at least two first mounting elements to mount a corresponding movable partition element on said guide rail;

each of said at least two first mounting elements being attached to the top portion of its corresponding movable partition element;

each of said at least two first mounting elements comprising at least two rollers;

said at least two rollers being disposed to roll on or in said guide rail to permit movement of each of said at least two first mounting elements and its corresponding partition element along said guide rail;

at least two drive units;

each of said at least two drive units being attached to a corresponding partition element;

a base mounting element to mount each said drive unit on its corresponding partition element;

each said drive unit being configured and disposed to move its corresponding partition element;

each said drive unit comprising:

an electric motor;

a drive shaft arrangement;

said drive shaft arrangement being connected to said electric motor;

said drive shaft arrangement comprising a projection to project from said drive shaft arrangement;

a second mounting element;

a bearing to hold said projection;

said bearing being inserted in said second mounting element;

at least one spacer;

said second mounting element being connected to said base mounting element by said at least one spacer;

an engagement structure having a surface;

said engagement structure being one of:

a. attached to said guide rail; and b. disposed adjacent to said guide rail;

said drive shaft arrangement being configured and disposed to engage said engagement surface to permit movement of said at least two partition elements;

a bus bar system;

said bus bar system being disposed adjacent to said guide rail;

said bus bar system being electrically insulated;

at least two current collectors;

said at least two current collectors being configured and disposed to receive electrical current from said bus bar system;

said at least two current collectors being configured and disposed to transfer electrical current to each said electric motor;

a spring arrangement;

said spring arrangement being configured and disposed to produce a biasing force on said at least two current collectors to provide contact between said at least two current collectors and said bus bar system;

a control unit;

said control unit being configured to be programmed to control the positioning and movement of each of said at least two partition elements;

said control unit being configured to sense electrical current related to each said electric motor; and said control unit being configured to determine a position on said guide rail of each said drive unit and its corresponding partition element upon sensing the flow of electrical current related to each said electric motor of each said drive unit.

2. Movable partition system according to claim 1, wherein:

said bus bar system comprises at least two bus bars;

at least one of said at least two bus bars is divided into a plurality of isolated segments;

each of said plurality of segments comprises an electrical connection; and each said electrical connection is configured to permit its corresponding segment to be supplied with current individually.

3. Movable partition system according to claim 2, wherein:

said control unit is configured to determine a position on said guide rail of each said drive unit and its corresponding partition element upon sensing the flow of electrical current related to each said electric motor of each said drive unit through one of said plurality of segments of said at least one divided bus bar.

4. Movable partition system according to claim 3, wherein:

said control unit is configured to determine an order of positioning on said guide rail of each said drive unit and its corresponding partition element according to a positioning program;

said control unit is configured to control the supply of electrical current to each said drive unit to move each said drive unit and its corresponding movable partition into said order of positioning according to said positioning program; and said control unit is configured to supply electrical current to a number of said divided bus bar segments, said number of said divided bus bar segments being disposed to provide a combined length of said bus bar segments which is substantially equivalent to a distance which said partition element moves to go from a starting position on said guide rail to a new position on said guide rail according to said positioning program.

5. Movable partition system according to claim 4, wherein:

said guide rail comprises a recess;

said engagement structure is disposed in or on said recess;

said engagement structure comprises a toothed belt;

said toothed belt comprises an engagement surface;

said engagement structure surface comprises said toothed belt engagement surface;

said drive shaft arrangement comprises a drive pinion;

said drive pinion is configured and disposed to be engaged with said toothed belt surface; and said drive pinion is engaged with said toothed belt surface.

6. Movable partition system according to claim 5, comprising:

a plurality of electric lines;

said plurality of electric lines being configured and disposed to connect said control system to said at least one divided bus bar; and each of said plurality of electric lines being connected to a corresponding electrical connection.

7. Movable partition system according to claim 6, wherein:

said electric motor is a direct current motor.

8. Movable partition system according to claim 4, wherein:

said guide rail comprises a recess;

said engagement structure is disposed in or on said recess;

a frictional engagement surface;

said engagement structure surface comprises said frictional engagement surface;

said drive shaft arrangement comprises a frictional drive wheel;

said drive wheel is configured and disposed to engage said frictional engagement surface; and said drive wheel is engaged with said frictional engagement surface.

9. Movable partition system according to claim 8, comprising:

a plurality of electric lines;

said plurality of electric lines being configured and disposed to connect said control system to said at least one divided bus bar; and each of said plurality of electric lines being connected to a corresponding electrical connection.

10. A movable partition system comprising:

at least two movable partition elements;

at least two of said at least two partition elements each comprising a drive unit;

each said drive unit comprising an electric motor to drive its corresponding partition element;

a guide rail;

each said drive unit being configured and disposed to move its corresponding partition element horizontally along or in said guide rail;

a bus bar system to provide energy related to each said electric motor;

said bus bar system being configured to conduct a flow of energy to each said drive unit and to conduct a flow of energy from each said drive unit;

a control unit;

said control unit being configured to be programmed to control the positioning and movement of each of said at least two partition elements;

said control unit being configured to sense energy related to each said electric motor; and said control unit being configured to determine a position on said guide rail of each said drive unit and its corresponding partition element upon sensing the flow of energy related to each said electric motor of each said drive unit.

11. Movable partition system according to claim 10, wherein:

said bus bar system comprises at least two bus bars;

at least one of said at least two bus bars is divided into a plurality of isolated segments;

each of said plurality of segments comprises an electrical connection; and each said electrical connection is configured to permit its corresponding segment to be supplied with energy individually.

12. Movable partition system according to claim 11, wherein:

said control unit is configured to determine a position on said guide rail of each said drive unit and its corresponding partition element upon sensing the flow of energy related to each said electric motor of each said drive unit through one of said plurality of segments of said at least one divided bus bar.

13. Movable partition system according to claim 12, wherein:

said control unit is configured to determine an order of positioning on said guide rail of each said drive unit and its corresponding partition element according to a positioning program;

said control unit is configured to control the supply of energy to each said drive unit to move each said drive unit and its corresponding movable partition into said order of positioning according to said positioning program; and said control unit is configured to supply energy to a number of said divided bus bar segments, said number of said divided bus bar segments being disposed to provide a combined length of said bus bar segments which is substantially equivalent to a distance which said partition element moves to go from a starting position on said guide rail to a new position on said guide rail according to said positioning program.

14. Movable partition system according to claim 13, wherein:

each said drive unit comprises a drive pinion;

said guide rail comprises a recess;

a toothed belt;

said toothed belt is disposed on or in said recess;

said drive pinion is configured and disposed to be engaged with said toothed belt; and said drive pinion is engaged with said toothed belt.

15. Movable partition system according to claim 14, comprising:

a plurality of electric lines;

said plurality of electric lines being configured and disposed to connect said control system to said at least one divided bus bar; and each of said plurality of electric lines being connected to a corresponding electrical connection.

16. Movable partition system according to claim 15, wherein:

said electric motor is a direct current motor.

17. Movable partition system according to claim 13, wherein:

each said drive unit comprises a frictional drive wheel;

said guide rail comprises a recess;

a frictional engagement structure having an engagement surface;

said frictional engagement structure is disposed in or on said recess;

said drive wheel is configured and disposed to engage said frictional engagement surface; and said drive wheel is engaged with said frictional engagement surface.

18. Movable partition system according to claim 17, comprising:

a plurality of electric lines;

said plurality of electric lines being configured and disposed to connect said control system to said at least one divided bus bar; and each of said plurality of electric lines being connected to a corresponding electrical connection.

19. A method for operating a movable partition system comprising: at least two movable partition elements; at least two of said at least two partition elements each comprising a drive unit; each said drive unit comprising an electric motor to drive its corresponding partition element; a guide rail; each said drive unit being configured and disposed to move its corresponding partition element horizontally along or in said guide rail; a bus bar system to provide energy related to said electric motor; said bus bar system being configured to conduct a flow of energy to each said drive unit and to conduct a flow of energy from each said drive unit; a control unit; said control unit being configured to be programmed to control the positioning and movement of each of said at least two partition elements; said control unit being configured to sense energy related to each said electric motor; and said control unit being configured to determine a position on said guide rail of each said drive unit and its corresponding partition element upon sensing the flow of energy related to each said electric motor of each said drive unit, said method comprising the steps of:

energizing said bus bar system with said control unit;

conducting a flow of energy between said bus bar system and each said drive unit;

providing energy to each said electric motor with said bus bar system;

sensing the energy related to each said electric motor with said control unit;

determining a position on said guide rail of each said drive unit and its corresponding partition element upon sensing the flow of energy related to each said electric motor of each said drive unit with said control unit;

determining an order of positioning on said guide rail of each said drive unit and its corresponding partition element with said control unit according to a positioning program in said control unit; and supplying energy with said control unit to said electric motor of said drive unit of at least one of said at least two partition elements to move said at least one of said at least two partition elements into the determined order of positioning on said guide rail according to the positioning program in said control unit.

20. The method for operating said movable partition system according to claim 19, wherein: said bus bar system comprises at least two bus bars; at least one of said at least two bus bars is divided into a plurality of isolated segments; each of said plurality of segments comprises an electrical connection; each said electrical connection is configured to permit its corresponding segment to be supplied with energy individually; said control unit is configured to determine a position on said guide rail of each said drive unit and its corresponding partition element upon sensing the flow of energy related to each said electric motor of each said drive unit through one of said plurality of segments of said at least one divided bus bar; said control unit is configured to determine an order of positioning on said guide rail of each said drive unit and its corresponding partition element according to a positioning program; said control unit is configured to control the supply of energy to each said drive unit to move each said drive unit and its corresponding movable partition into said order of positioning according to said positioning program; said control unit is configured to supply energy to a number of said divided bus bar segments, said number of said divided bus bar segments being disposed to provide a combined length of said bus bar segments which is substantially equivalent to a distance which said partition element moves to go from a starting position on said guide rail to a new position on said guide rail according to said positioning program; each said drive unit comprises a drive pinion; said guide rail comprises a recess; a toothed belt; said toothed belt is disposed on or in said recess; said drive pinion is configured and disposed to be engaged with said toothed belt; said drive pinion is engaged with said toothed belt; a plurality of electric lines; said plurality of electric lines being configured and disposed to connect said control system to said at least one divided bus bar; each of said plurality of electric lines being connected to a corresponding electrical connection; said electric motor is a direct current motor, said method comprising the further steps of:

supplying energy individually with said control unit to each of said plurality of segments through the corresponding electrical line and electrical connection of each of said plurality of segments;

determining a position on said guide rail of each said drive unit and its corresponding partition element with said control unit upon sensing with said control unit the flow of energy related to each said electric motor of each said drive unit through one of said plurality of segments of said at least one divided bus bar;

determining an order of positioning on said guide rail of each said drive unit and its corresponding partition element with said control unit according to said positioning program of said control unit;

supplying energy with said control unit individually through the corresponding electrical connections of said divided bus bar segments to energize said number of said divided bus bar segments substantially equivalent to a distance which said partition element is to move; and energizing said electric motor of said drive unit through said number of divided bus bar segments to turn said drive pinion engaged in said toothed belt to move said partition element along said guide rail according to said positioning program.

* * * * *

UNITED STATES PATENT AND TRADEMARK OFFICE

CERTIFICATE OF CORRECTION

PATENT NO. : 6,082,053

DATED : July 4, 2000

INVENTOR(S) : Markus BISCHOF, Lothar GINZEL and Stefan RECHSTEINER

It is certified that error appears in the above-identified patent and that said Letters Patent is hereby corrected as shown below:

On the title page, item [75], after 'Bischof,', delete "Altenhrain," and insert --Altenhrein,--.

On the title page, item [75], after 'Ginzel,', delete "Sobwerto," and insert --Schwerte,--.

On the title page, item [75], after 'Rechsteiner,', delete "Stead," and insert --Staad,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*